US007667449B2

(12) United States Patent
Takeda

(10) Patent No.: US 7,667,449 B2
(45) Date of Patent: Feb. 23, 2010

(54) CONSTANT CURRENT SUPPLY CIRCUIT CAPABLE OF BEING TRIMMED

(75) Inventor: Akira Takeda, Chiba (JP)

(73) Assignee: Seiko Instruments Inc., Chiba (JP)

( * ) Notice: Subject to any disclaimer, the term of this patent is extended or adjusted under 35 U.S.C. 154(b) by 391 days.

(21) Appl. No.: 11/704,678

(22) Filed: Feb. 8, 2007

(65) Prior Publication Data

US 2008/0018315 A1 Jan. 24, 2008

(30) Foreign Application Priority Data

Feb. 9, 2006 (JP) ..... 2006-032564

(51) Int. Cl.
*G05F 3/16* (2006.01)

(52) U.S. Cl. ..... 323/315

(58) Field of Classification Search ..... 323/315
See application file for complete search history.

(56) References Cited

U.S. PATENT DOCUMENTS

| | | | | |
|---|---|---|---|---|
| 5,889,430 | A * | 3/1999 | Csanky | 327/543 |
| 5,966,005 | A * | 10/1999 | Fujimori | 323/315 |
| 6,351,111 | B1 * | 2/2002 | Laraia | 323/315 |
| 6,819,164 | B1 * | 11/2004 | Chen | 327/540 |
| 7,479,821 | B2 * | 1/2009 | Imura | 327/538 |

FOREIGN PATENT DOCUMENTS

| | | |
|---|---|---|
| JP | 6-195141 A | 7/1994 |

* cited by examiner

*Primary Examiner*—Jeffrey L Sterrett
(74) *Attorney, Agent, or Firm*—Brinks Hofer Gilson & Lione

(57) ABSTRACT

To provide a constant current circuit which is capable of not only acquiring characteristics of various sorts of electric circuits even before a trimming adjustment is carried out, performing the trimming adjustment based upon the acquired characteristics, performing trimming processes to both the constant current circuit and a load collectively, and performing an adjustment of a constant current with high precision, but also capable of reducing a total number of manufacturing steps so that a production cost can be lowered, as compared with that of a conventional constant current circuit.

A constant current circuit of the present invention includes: a current output portion including a first transistor for causing a reference current to flow and a second transistor for causing an output current with respect to a load to flow, the first transistor and the second transistor connected with each other through a current mirror connection; a depletion transistor connected in series with the first transistor, for adjusting the reference current through trimming; a third transistor interposed between the depletion transistor and a ground point, for controlling tuning on/off of a connection between the depletion transistor and the ground point; and a first external terminal for allowing the reference current to flow through the first transistor.

11 Claims, 2 Drawing Sheets

CONSTANT CURRENT SUPPLY CIRCUIT CAPABLE OF BEING TRIMMED

TECHNICAL FIELD

The present invention relates to a constant current circuit formed as a semiconductor integrated circuit, for producing and outputting a constant current. In particular, the present invention relates to a constant current circuit capable of being trimmed.

BACKGROUND ART

Constant current circuits are basic circuits which are widely used in various sorts of electronic circuits which require constant currents, for example, a lamp voltage generating circuit and a triangular wave generating circuit. Those constant current circuits are required to supply constant currents to the various sorts of electronic circuits employing the constant current circuits with high precision.

For instance, as shown in FIG. 3, a constant current circuit is composed of transistors 204 and 205 which are p-type MOS transistors, and an n-type depletion transistor 203, and a constant current is supplied to a load 206.

However, the constant current circuit using the depletion transistor as described above has a problem in that current values are varied due to manufacturing variations in manufacturing steps.

To solve the above-mentioned problem, a plurality of sorts of depletion transistors are prepared, trimmings are carried out in order to adjust the current values, and thus, expected current values are obtained (refer to, for example, JP 06-195141 A).

However, when such constant current circuits are employed, proper current values cannot be supplied to circuits such as a regulator, a differential amplifier, a D/A converter, and an A/D converter which are required to be trimmed, unless those constant current circuits have been subjected to trimming adjustment, whereby trimmings for adjusting characteristics of various sorts of electric circuits cannot be carried out.

Thus, a semiconductor circuit using the conventional constant current circuit configuration requires, for example, the following steps:

a. Forming a dummy depletion transistor similar to the constant current circuit in the vicinity of the constant current circuit, and measuring a current value of the depletion transistor.
b. Carrying out a trimming adjustment of the constant current circuit based upon the measured current value.
c. Testing characteristics of various sorts of electric circuits, corresponding to a load.
d. Carrying out trimmings of various sorts of the electric circuits.
e. Performing a shipping check to ship the semiconductor circuit.

As described above, both the tests of the electric characteristics and the trimming process must be separately carried out with respect to the constant current circuit and each of the various sorts of electric circuits to which the constant current is to be supplied. Accordingly, the above-mentioned 5 steps are required, resulting in such drawbacks that much time and effort are required in manufacturing and that a production cost is increased.

The present invention has been made to in view of the above-mentioned circumstances and therefore has an object to provide a constant current circuit capable of not only acquiring characteristics of current values of various sorts of electric circuits even before a trimming adjustment is carried out, performing the trimming adjustment based upon the acquired characteristics, performing trimming processes to both the constant current circuit and a load collectively, and performing adjustments of the respective characteristics with high precision, but also capable of reducing a total number of manufacturing steps so that the production cost can be lowered, as compared with that of the conventional constant current circuit.

SUMMARY OF THE INVENTION

To solve the above-mentioned problems, a constant current circuit according to the present invention includes: a current output portion including a first transistor (e.g., transistor 104 in embodiments) for causing a reference current to flow and a second transistor (e.g., transistor 105 in the embodiments) for causing an output current with respect to a load (e.g., load 106 in the embodiments) to flow, the first transistor and the second transistor connected with each other through a current mirror connection; a depletion transistor (e.g., transistor 103 in the embodiments) connected in series with the first transistor, for adjusting the reference current through trimming; a third transistor (e.g., transistor 107 in the embodiments) interposed between the depletion transistor and a ground point, for controlling tuning on/off of a connection between the depletion transistor and the ground point; and a first external terminal for allowing the reference current to flow through the first transistor.

In the constant current circuit according to the present invention, the third transistor has a gate provided with a second external terminal for applying a voltage.

The constant current circuit according to the present invention further includes: an inverter which is interposed between the second external terminal and the gate of the third transistor in such a manner that an input terminal thereof is connected to the second external terminal and an output terminal thereof is connected to the gate of the third transistor; and a pull-down resistor interposed between the input terminal of the inverter and the ground point.

As described above, in the constant current circuit of the present invention, switching is carried out between a mode in which the third transistor is turned on to measure the current value of the depletion transistor from the outside and a mode in which the third transistor is turned off to measure the electric characteristics of the load by causing the reference current to flow through the first external terminal without supplying a current to the depletion transistor, by the second external terminal without connecting the power supply to the power supply terminal, whereby the electric characteristics of the load can be measured even before the trimming adjustment of the constant current circuit is carried out.

As described above, according to the constant current circuit of the present invention, since accurate electric characteristics of the load can be tested before the trimming adjustment of the resistor portion, in the case of a load which requires a trimming adjustment, both the characteristics of the load and the depletion transistor are measured at the same time, and the trimmings of the depletion transistor and the various sorts of electric circuits of the load can be simultaneously carried out. Thus, the number of steps as a whole can be reduced, and the production cost can be decreased.

Further, according to the constant current circuit of the present invention, the current value of not to the dummy but the depletion transistor itself can be measured. Thus, trimming of the current value can be carried out with high precision.

DETAILED EXPLANATION OF PREFERRED EMBODIMENTS

Referring now to drawings, a description is made of a constant current circuit according to an embodiment of the present invention.

Figure 1:
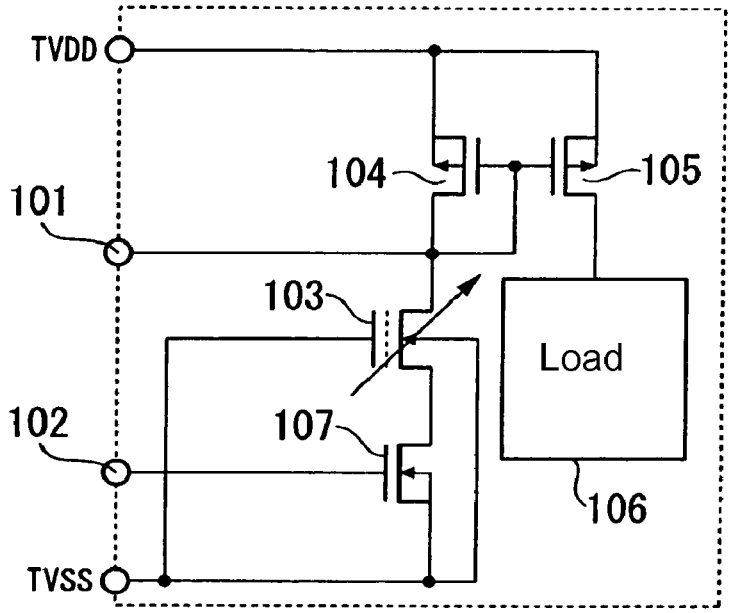
FIG. 1 is a block diagram for showing a structural example of a constant current circuit according to an embodiment of the present invention.

FIG. 1 is a block diagram for showing a structural example of the constant current circuit according to this embodiment.

In the figure, the constant current circuit which supplies a constant current to a load 106 is composed of a transistor 104, a transistor 105, a transistor 107, and a transistor 103. Here, both the transistors 104 and 105 are p-type MOS transistors of an enhancement type; the transistor 103 is an n-type MOS transistor of a depletion type; and a transistor 107 corresponds to an n-type MOS transistor of the enhancement type.

A source of the above-mentioned transistor 104 is connected to a power supply (VDD) terminal TVDD and a gate and a drain thereof are connected to a drain of the transistor 103, whereby a reference current is caused to flow in the constant current circuit.

A source of the transistor 105 is connected to the power supply terminal, a gate thereof is connected to the gate of the transistor 104, and a drain thereof is connected to a predetermined circuit in the load, whereby an output current with respect to the load is caused to flow. As described above, both the transistor 104 and the transistor 105 are connected to each other through a current mirror connection, and an output current identical to the reference current flowing through the transistor 104 flows through the transistor 105.

The transistor 103 is connected in series with the transistor 104. In other words, a drain of the transistor 103 is connected to the drain of the transistor 104, and a source thereof is connected to a drain of the transistor 107, whereby a current value for controlling the above-mentioned reference current is adjusted by trimming. For instance, the transistor 103 is composed of a matrix of a plurality of n-type MOS transistors of the depletion type, and bypassing wiring for determining whether to use the n-type MOS transistor is cut off by a laser or the like so as to adjust the current value.

The drain of the transistor 107 is connected to the source of the transistor 103, a source thereof is grounded, and the transistor 107 is interposed between the transistor 103 and the ground point. The transistor 107 is turned on/off by a voltage applied to a gate thereof so as to control the connection between the source of the transistor 103 and the ground point.

An external terminal 101 (first external terminal) is provided in order to apply a measuring voltage to a connection point between the transistor 104 and the transistor 103 (namely, both drains), and to apply a voltage of the transistor 103 or to cause the reference current to flow from an external source to the transistor 104.

An external terminal 102 (second external terminal) is provided in order to apply a voltage for controlling turning on/off of the transistor 107 to the gate of the transistor 107.

The load 106 corresponds to various sorts of circuits which require trimmings in order to satisfy predetermined performance with respect to the current value of the above-mentioned reference current, for example, a regulator, a differential amplifier, a D/A converter, and an A/D converter.

Referring now to FIG. 1, a description is made of an operation example of this embodiment.

In a measuring device (not shown), an "H" level, namely a signal having a VDD potential is applied to the external terminal 102 so as to turn on the transistor 107. Further, a measuring voltage is applied from an external source to the external terminal 101 without connecting the power supply terminal TVDD to the power supply (VDD: power supply voltage), thereby measuring a current flowing through the transistor 103.

Then, the above-mentioned measuring device outputs the measured current value, namely, control data for selecting a subject which is to be cut off from a depletion transistor array by using a laser, namely for selecting the transistor 103 so as to perform trimming adjustment of a resistance value of the transistor 103.

Next, the measuring device applies an "L" level, namely, a signal of a power supply $V_{ss}$ (ground potential) to the external terminal 102 so as to turn off the transistor 107. In addition, while the power supply terminal TVDD is connected to the power supply VDD, the measuring device applies a measuring voltage to the external terminal 101 so as to cause a current corresponding to a set value (for example, 10 μA) of the reference current, namely, a current corresponding to a reference current flowing through the transistor 104 after the trimming adjustment of the transistor 103, to flow from the external source. The power supply $V_{ss}$ is supplied from the power supply terminal $TV_{ss}$.

Then, the measuring device supplies an output current (current corresponding to the reference current) from the transistor 105 connected to the transistor 104 through the current mirror connection based upon the above-mentioned reference current so as to test the characteristics of the load 106. In other words, the measuring device supplies a current to be supplied to the load, which has been set when the constant current circuit has been designed, in a quasi manner as if the trimming adjustment of the transistor 103 has been carried out, to test the characteristics of the load 106.

At this time, if the load 106 is, for example, an A/D converter, the measuring device measures whether or not the inputted voltage is converted into a correct digital value, and detects to what degree a resistance is to be adjusted based upon a preset resistance value and the measured resistance value. For obtaining a required resistance value from this detected result, the measuring device selects a subject of the laser cutting process from trimming elements (for instance, depletion transistor array and resistor array), that is, the measuring device outputs control data used for the trimming adjustment of the resistance value of the trimming elements in the load 106.

According to the configuration of the present invention, in the above-mentioned test of the measuring device, the measurement of the resistance value of the transistor 103 in the constant current circuit and the electric characteristics of the load 106 can be carried out at the same time, and the control data required in the trimming process can be acquired collectively.

Next, trimming adjustments for the transistor 103 and a transistor, a resistor, and the like provided in the load 106 are carried out. In other words, by inputting the above-mentioned control data to a trimming apparatus, the trimming apparatus adjusts the transistor 103 as the trimming element by laser trimming and the like based upon the inputted control data so as to control the constant current circuit to cause the reference current, which has been previously set when the constant current circuit has been designed, to flow.

Similarly, the trimming apparatus adjusts the resistance values of the various sorts of electric circuits provided in the load 106 by laser trimming and the like based upon the inputted control data so as to perform control such that the various sorts of electric circuits exhibit electric characteristics which have been previously set when those electric circuits have been designed.

As described above, by providing the transistor 107 for controlling whether or not to cause the current to flow through the transistor 103, and the external terminal 101 for allowing the current to flow from the external source with respect to the transistor 103, the current value of the transistor 103 can be measured.

Also, by causing the reference current to flow from the external source to the transistor 104 while no current is caused to flow through the transistor 103, the transistor 103 is brought into a condition similar to the condition after the trimming adjustment of the transistor 103 and the electric characteristics of the load 106 are tested, whereby the control data with respect to the trimming adjustment can be acquired.

As a result, in the conventional constant current circuit, in order to adjust the reference current in the constant current circuit, 5 steps in total are required, including measuring the dummy trimming element having the similar structure as that of the trimming element for producing the reference current (step 1); performing trimming adjustment of the trimming element for producing the reference current (step 2); detecting the electric characteristics of the load 106 which is operated by the current outputted from the constant current circuit (step 3); performing the trimming process of the load 106 based upon the detected result (step 4); and testing whether or not the load 106 is operated normally to ship the constant current circuit (step 5).

On the other hand, as described above, in the constant current circuit according to this embodiment, since the transistor 107 and the external terminal 101 are provided, 3 steps in total are required, including testing the resistance value of the constant current circuit and the electric characteristics of the load 106 (step 1); performing the trimming process based upon the test result (step 2); and testing whether or not the load 106 is operated normally to ship the constant current circuit (step 3). Thus, the steps required for the shipment can be largely reduced, as compared with the 5 steps of the conventional example.

Also, since the external terminal is provided in the constant current circuit according to this embodiment, the trimming element for producing the reference current can be directly measured, and the adjustment can be carried out with higher precision than the conventional example in which the control data required for the indirect trimming process is extracted by using the dummy.

Also, when the constant current circuit is mounted to a product, it is required that the external terminal 102 be connected to the power supply VDD and the signal having the "H" level be constantly inputted to the gate of the transistor 107. On the other hand, when an unnecessary voltage or current flows through the external terminal 101, the constant current circuit is not operated normally, so the external terminal 101 must be in an open status.

Figure 2:
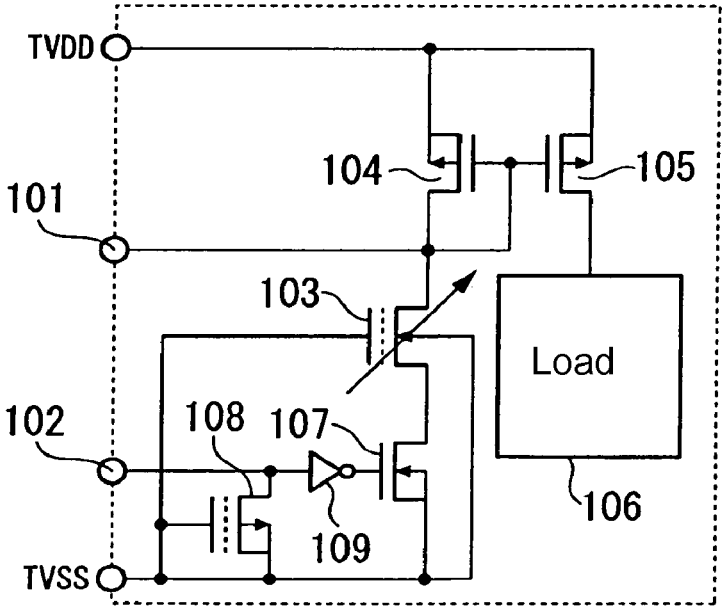
FIG. 2 is a block diagram for showing a structural example of a constant current circuit according to another embodiment of the present invention.
Figure 3:
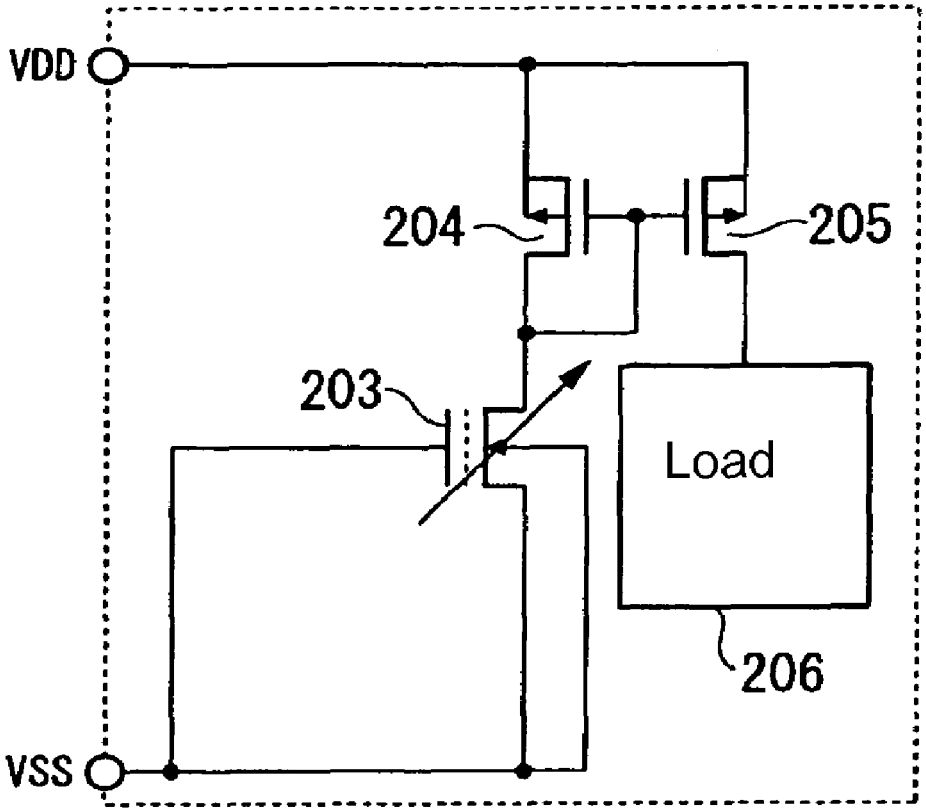
FIG. 3 PRIOR ART
FIG. 3 is a block diagram for showing a configuration of a conventional constant current circuit.

Next, as another embodiment, as are shown in FIG. 2, there is a structure in which an inverter 109 and an n-type MOS transistor 108 of a depletion type provided to the embodiment of FIG. 1. FIG. 2 is a block diagram for indicating a structural example of a constant current circuit according to the another embodiment.

In FIG. 2, an input terminal of the inverter 109 is connected to the external terminal 102, and an output terminal of the inverter 109 is connected to the gate of the transistor 107.

As a consequence, in the case where the transistor 107 is brought into an on status, a signal having an "L" level is inputted with respect to the external terminal 102. On the other hand, in the case where the transistor 107 is brought into an off status, a signal having an "H" level is inputted to the external terminal 102.

Also, the depletion transistor 108 is interposed between the input terminal of the inverter 109 and the ground point. In this case, the drain of the depletion transistor 108 is connected to the input terminal of the inverter 109, and both the gate and the drain thereof are connected to the ground point, so that this depletion transistor 108 is operated as a constant current source.

In the constant current circuit of FIG. 1, after the control data for the trimming adjustment is acquired, when the constant current circuit is mounted on a product, it is required that the external terminal 102 is connected to the power supply (VDD), and thus, the signal having the "H" level is inputted.

However, in the embodiment of FIG. 2, when the constant current circuit is mounted on a product, even when the external terminal 102 is not connected to power supplies of the power supply VDD and the power supply $V_{ss}$ and in an open status, the input terminal of the inverter 109 is in the ground voltage ("L" level) status due to the depletion transistor 108. As a result, while a signal having the "H" level is outputted to the gate of the transistor 107 by the inverter 109 and thus the transistor 107 is in the on status. In this case, if the power supply VDD is connected to the terminal TVDD, the reference current is in a status in which a reference current flows through the transistor 103, and the constant current circuit supplies the reference current (output current) with respect to the load 106.

Also, the above-mentioned depletion transistor 108 may be alternatively replaced by such a resistor having a resistance value range between a resistance value (higher resistance value) and another resistance value (lower resistance value). The higher resistance value causes the potential at the gate of the transistor 107 to be the "L" level when the external terminal 102 is in the open status. The lower resistance value causes the potential at the input terminal of the inverter 109 to the "H" level by which when the signal having the "H" level is inputted to the external terminal 102, the inverter 109 detects the input as the "H" level, performs the inverting operation, and thus, sets the output as the "L" level.

The invention claimed is:

1. A constant current circuit, comprising:

a current output portion including a first transistor for causing a reference current to flow and a second transistor for causing an output current with respect to a load to flow, the first transistor and the second transistor connected with each other through a current mirror connection;

a depletion transistor connected in series with the first transistor, for adjusting the reference current through trimming, the depletion transistor comprising a drain connected to a drain of the first transistor;

a third transistor interposed between the depletion transistor and a ground point, for controlling the turning on and off of a connection between the depletion transistor and the ground point; and a first external terminal that applies a measuring voltage to the drains of the first transistor and the depletion transistor for allowing the reference current to flow through the first transistor.

2. The constant current circuit according to claim 1, wherein the third transistor has a gate provided with a second external terminal for applying a voltage.

3. The constant current circuit according to claim 2, further comprising:

an inverter which is interposed between the second external terminal and the gate of the third transistor in such a manner that an input terminal thereof is connected to the second external terminal and an output terminal thereof is connected to the gate of the third transistor.

4. The constant current circuit according to claim 3, further comprising a pull-down resistor interposed between the input terminal of the inverter and the ground point.

5. The constant current circuit according to claim 3, further comprising a further depletion transistor comprising:

a gate and a source connected to the ground point; and a drain connected to the input terminal of the inverter and to the second external terminal.

6. The constant current circuit according to claim 1, where the third transistor comprises:

a drain connected to a source of the depletion transistor; and a source connected to the ground point.

7. A constant current circuit, comprising:

a current output portion including a first transistor for causing a reference current to flow and a second transistor for causing an output current with respect to a load to flow, the first transistor and the second transistor connected with each other through a current mirror connection;

a first depletion transistor connected in series with the first transistor, for adjusting the reference current through trimming;

a third transistor interposed between the first depletion transistor and a ground point, for controlling the turning on and off of a connection between the first depletion transistor and the ground point;

an inverter which is interposed between the second external terminal and the gate of the third transistor in such a manner that an input terminal thereof is connected to the second external terminal and an output terminal thereof is connected to the gate of the third transistor;

a second depletion transistor comprising:

a gate and a source connected to the ground point; and a drain connected to the input terminal of the inverter and to the second external terminal; and a first external terminal for allowing the reference current to flow through the first transistor.

8. The constant current circuit according to claim 7, where the first depletion transistor comprises a drain connected to a drain of the first transistor.

9. The constant current circuit according to claim 7, wherein the third transistor comprises a gate provided with a second external terminal for applying a voltage.

10. The constant current circuit according to claim 7, where the third transistor comprises:

a drain connected to a source of the depletion transistor; and a source connected to the ground point.

11. The constant current circuit according to claim 7, where the first external terminal applies a measuring voltage to the drains of the first transistor and the depletion transistor for allowing the reference current to flow through the first transistor.

* * * * *

UNITED STATES PATENT AND TRADEMARK OFFICE

CERTIFICATE OF CORRECTION

PATENT NO. : 7,667,449 B2
APPLICATION NO. : 11/704678
DATED : February 23, 2010
INVENTOR(S) : Akira Takeda It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 406 days.

Signed and Sealed this

Seventh Day of December, 2010

David J. Kappos

David J. Kappos
*Director of the United States Patent and Trademark Office*